US009713372B1

(12) United States Patent
Chen

(10) Patent No.: US 9,713,372 B1
(45) Date of Patent: Jul. 25, 2017

(54) ROUNDED HAMMOCK

(71) Applicant: Samuel Chen, Hong Kong (CN)

(72) Inventor: Samuel Chen, Hong Kong (CN)

( * ) Notice: Subject to any disclaimer, the term of this patent is extended or adjusted under 35 U.S.C. 154(b) by 0 days.

(21) Appl. No.: 15/481,895

(22) Filed: Apr. 7, 2017

Related U.S. Application Data

(60) Provisional application No. 62/323,925, filed on Apr. 18, 2016.

(51) Int. Cl.
*A45F 3/22* (2006.01)

(52) U.S. Cl.
CPC ..... *A45F 3/22* (2013.01)

(58) Field of Classification Search
CPC ..... A45F 3/22
USPC ..... 5/120–122, 98.3, 98.1, 101, 655
See application file for complete search history.

(56) References Cited

U.S. PATENT DOCUMENTS 2,930,430 A 3/1960 Bloom
3,130,969 A 4/1964 Groth
3,145,990 A 8/1964 Prouty
5,963,996 A * 10/1999 Hsia ..... A47D 13/066 256/25
6,041,455 A * 3/2000 Raffo ..... A47D 11/00 5/98.1
7,367,068 B2 5/2008 Huff
D702,449 S 4/2014 Puotiniemi
D738,637 S 9/2015 Dean
9,468,284 B2 10/2016 Wehner
2009/0165205 A1* 7/2009 Hennessy ..... A45F 3/22 5/122
2012/0175928 A1 7/2012 Eber
2015/0076888 A1 3/2015 Xu

* cited by examiner

*Primary Examiner* — Fredrick Conley
(74) *Attorney, Agent, or Firm* — Clement Cheng

(57) ABSTRACT

A rounded hammock includes a middle panel having a rounded profile and a center. At least four sidewalls, include a first sidewall, a second sidewall, a third sidewall, and a fourth sidewall connected to the middle panel. A first pleat is formed on the first sidewall. A second pleat is formed on the second sidewall. A third pleat is formed on the third sidewall. A fourth pleat is formed on the fourth sidewall. A first pleat cover is stitched over the first pleat. A second pleat cover is stitched over the second pleat. A third pleat cover is stitched over the third pleat. A fourth pleat cover is stitched over the fourth pleat.

7 Claims, 3 Drawing Sheets

ROUNDED HAMMOCK

This application is a non-provisional of and claims priority from U.S. provisional patent application 62/323,925 entitled Rounded Hammock by inventor Samuel Chen, filed Apr. 18, 2016, the disclosure of which is incorporated herein by reference.

FIELD OF THE INVENTION

The present invention is in the field of hammocks and swings.

DISCUSSION OF RELATED ART

A variety of differently shaped hammocks and differently shaped swings have seats for seating users. It is designed to improve the current construction of the recreational hammock swing.

For example, in U.S. patent publication 20150076888, entitled Swinging Chair and published on Mar. 19, 2015, inventor Xu describes a swinging chair with a circular base seat that may be hanged or otherwise suspended to a support structure. The base is movable in vertical and lateral planes with respect to at least one support point, the disclosure of which is incorporated herein by reference.

U.S. design Pat. D738,637, entitled Hanging Chair and published on Sep. 9, 2015, by inventor Dean presents a hanging chair composed of multiple concentric circular bands surrounding a disk base and suspended with cable supports at various points within the circular bands, the disclosure of which is incorporated herein by reference. Inventor Huff illustrates "a hammock/hanging bed with a web stretched across a typically round support frame and supported via tension member lines/rods/material to one or more overhead points" in U.S. Pat. No. 7,367,068, entitled Overhead Supported Hammock Bed and published on May 6, 2008, the disclosure of which is incorporated herein by reference.

In U.S. design Pat. D702,449, entitled Swing and published on Apr. 2, 2013, inventor Puotiniemi illustrates a circular seat suspended to a support frame via cables, the disclosure of which is incorporated herein by reference.

U.S. Pat. No. 9,468,284, entitled Hanging chair and published on Oct. 18, 2016, by inventor Wehner describes an external support structure with multiple upright supports that extend from an upper frame member to a lower frame member. The upright supports are moveable from a collapsed to an expanded position. The disclosure of which is incorporated herein by reference.

Inventor Monachello presents a disc swing seat capable of being hung from a support structure. The seat comprises of an outer ring covered with breathable material that can accommodate several individual users at once and maintain a cool temperature, even when placed in direct sunlight for extended amounts of time, the disclosure of which is incorporated herein by reference.

A centrally depressed conical pocket of circular outline serves as the seating surface of inventor Bloom's tilt chair/chaise lounge/hammock. U.S. Pat. No. 2,930,430, entitled Multiple Tilt Chair, chaise lounge or hammock and published Mar. 29, 1960. Extending around the conical pocket is a continuous circular rim which conforms to the shape of the pocket. A base structure provides the ability for the device to tilt such that four different resting surfaces may be attained, the disclosure of which is incorporated herein by reference.

In U.S. Pat. No. 3,130,969, entitled Swing and published Apr. 28, 1964, by inventor Groth, "a circular seat is supported in a horizontal plane by diametrically opposed ropes which extend upwardly to form an apex by which the seat is supported." This structure may swing, gyrate, or rotate in a variety of directions. Furthermore, the swing may be simultaneously used by multiple individuals, the disclosure of which is incorporated herein by reference.

Inventor Prouty describes a rocking amusement apparatus in U.S. Pat. No. 3,145,990, entitled Rocking amusement apparatus and published Aug. 25, 1964. The apparatus is constructed from metal tubing or piping and can be used outdoors. The apparatus is light in weight and therefore easily transportable, the disclosure of which is incorporated herein by reference.

U.S. patent publication 20120175928, entitled Seating assembly with pivoting motion and published Jul. 12, 2012, by inventor Eber describes a seat portion comprising of an upper suspension member and a lower pivot member. The upper suspension member may be freely suspended and is pivotable, the disclosure of which is incorporated herein by reference.

SUMMARY OF THE INVENTION

The present invention is a rounded hammock that is of a rounded shape circular shaped or oval shaped. A rounded hammock includes a middle panel having a rounded profile and a center. At least four sidewalls, include a first sidewall, a second sidewall, a third sidewall, and a fourth sidewall connected to the middle panel. A first pleat is formed on the first sidewall. A second pleat is formed on the second sidewall. A third pleat is formed on the third sidewall. A fourth pleat is formed on the fourth sidewall. A first pleat cover is stitched over the first pleat. A second pleat cover is stitched over the second pleat. A third pleat cover is stitched over the third pleat. A fourth pleat cover is stitched over the fourth pleat.

At least four sleeves are stitched to the four sidewalls. Each of the at least four sleeves has a sleeve pocket with a pair of openings. The four sleeves include a first sleeve stitched to the first sidewall, a second sleeve stitched the second sidewall, a third sleeve stitched to the third sidewall, and a fourth sleeve stitched to the fourth sidewall. The first sleeve is stitched at least partially over the first pleat cover. The second sleeve is stitched at least partially over the second pleat cover. The third sleeve is stitched at least partially over the third pleat cover. The fourth sleeve is stitched at least partially over the fourth pleat cover.

The rounded hammock also optionally has a sidewall base strip stitched between the four sidewalls and the middle panel at a middle panel fringe. The sidewall base strip also has a base strip inside stitch and a base strip outside stitch. The base strip inside stitch is connected to the middle panel. The base strip outside stitch is connected to the four sidewalls. The four sleeves are connected to the at least four sidewalls by a sleeve inner stitch and a sleeve outer stitch. The sleeve inner stitch has a smaller diameter than the sleeve outer stitch. The sidewall base strip is stitched between the four sidewalls and the middle panel at a middle panel fringe.

The sidewall base strip also has a base strip inside stitch and a base strip outside stitch. The base strip inside stitch is connected to the middle panel, and the base strip outside stitch is connected to the at least four sidewalls. Each of the pleat covers including the first pleat cover, the second pleat cover, the third pleat cover and the fourth pleat cover a pleat cover panel extends from a lower surface of each respective pleat to an upper surface of each respective pleat. Each pleat cover panel has a lower inside edge that is folded underneath each respective pleat cover panel to be retained between the middle panel and each respective pleat cover panel.

Figure 1:
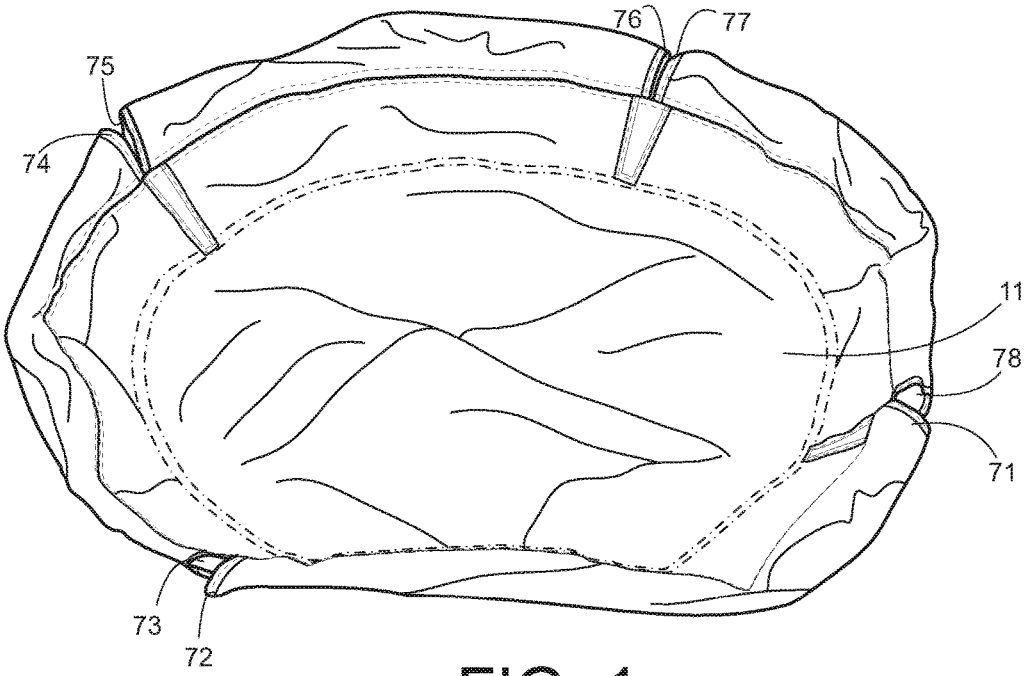
FIG. 1 is a perspective view of the present invention.
Figure 2:
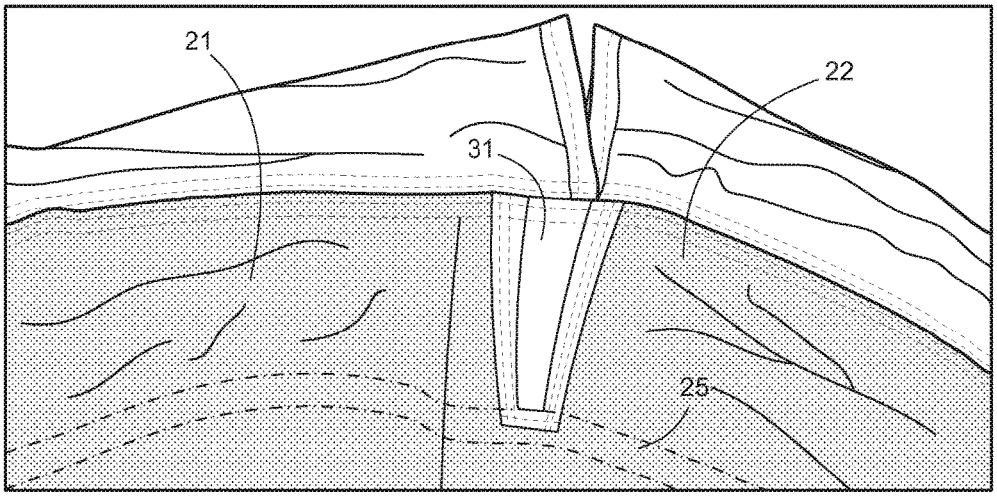
FIG. 2 is a close-up view of the pleat and sleeve opening.
Figure 3:
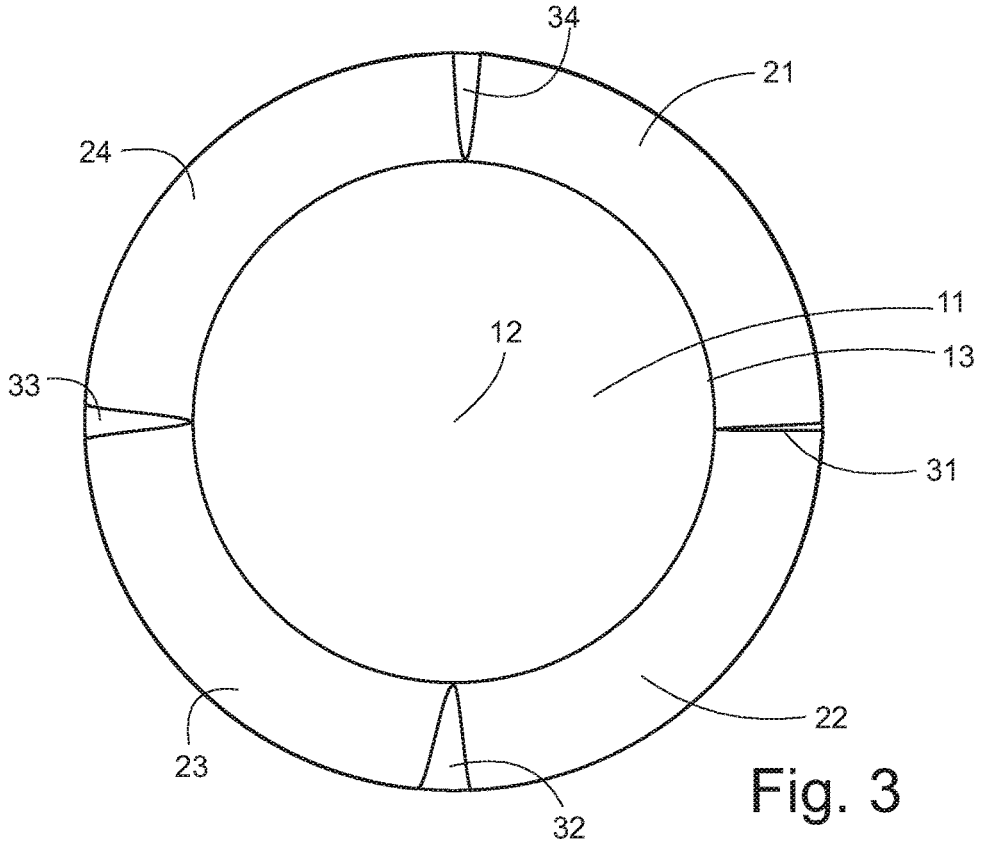
FIG. 3 is a top view of the present invention in the first construction phase.
Figure 4:
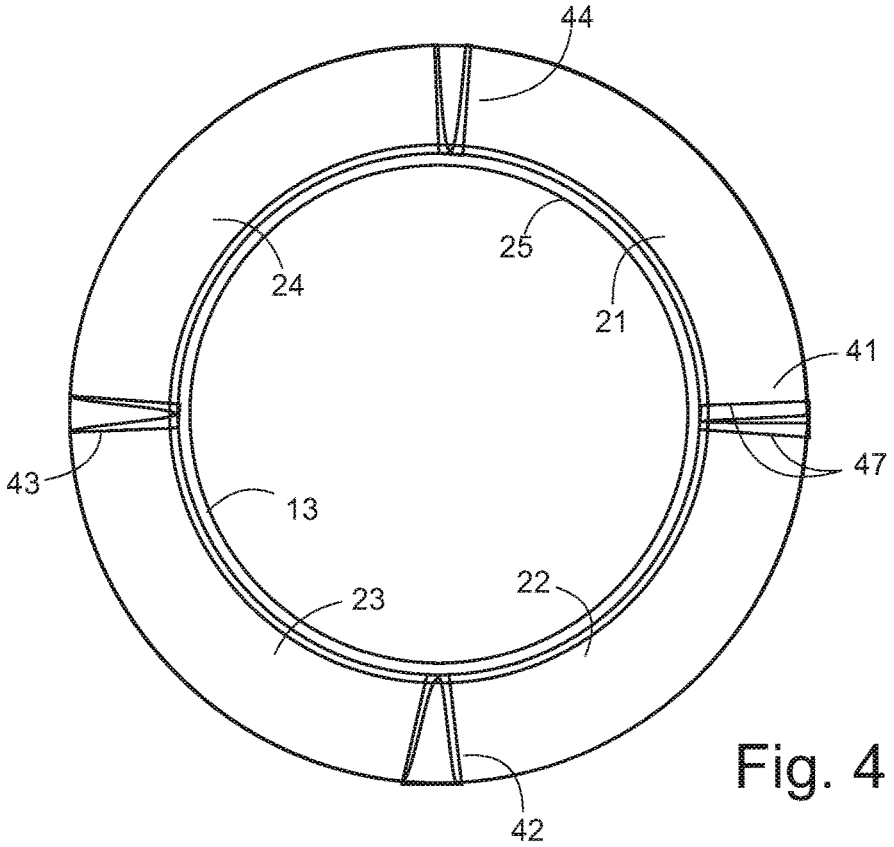
FIG. 4 is a top view of the present invention in the second construction phase.
Figure 5:
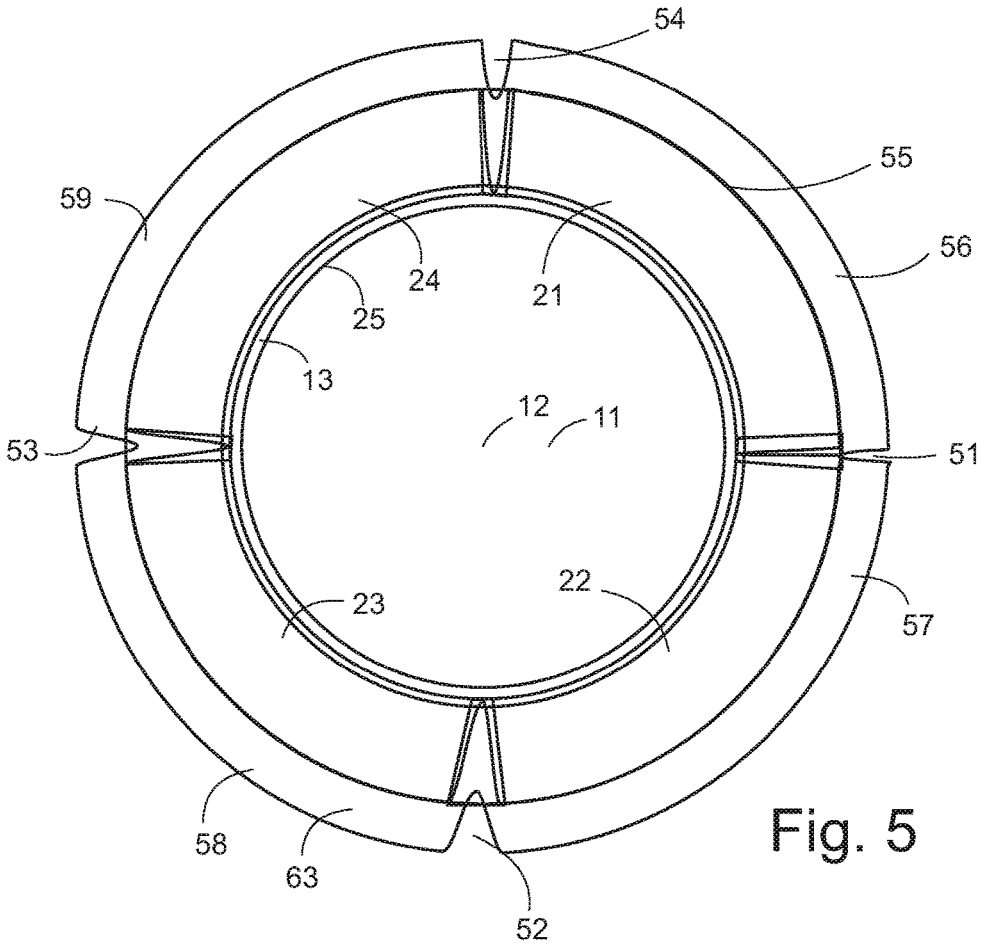
FIG. 5 is a top view of the present invention in the third construction phase.
Figure 6:
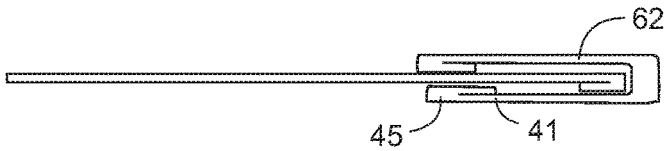
FIG. 6 is a cross-section view of the present invention in the second construction phase.
Figure 7:
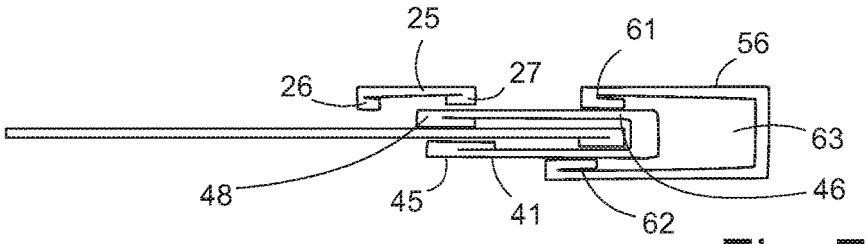
FIG. 7 is a cross-section view of the present invention in the third construction phase.

The following call out list of elements can be a useful guide in referencing the elements of the drawings.

11 Middle Panel
12 Center Of Middle Panel
13 Middle Panel Fringe
21 First Sidewall
22 Second Sidewall
23 Third Sidewall
24 Fourth Sidewall
25 Sidewall Base Strip
26 Base Strip Inside Stitch
27 Base Strip Outside Stitch
31 First Pleat
32 Second Pleat
33 Third Pleat
34 Fourth Pleat
41 First Pleat Cover Panel
42 Second Pleat Cover Panel
43 Third Pleat Cover Panel
44 Fourth Pleat Cover Panel
45 Pleat Cover Inside Stitch
46 Pleat Cover Outside Stitch
48 Pleat Cover Top Stitch
51 First Sleeve Opening
52 Second Sleeve Opening
53 Third Sleeve Opening
54 Fourth Sleeve Opening
55 Sleeve Stitch
56 First Sleeve
57 Second Sleeve
58 Third Sleeve
59 Fourth Sleeve
61 Sleeve Outer Stitch
62 Sleeve Inner Stitch
63 Sleeve Pocket
71 First Sleeve First Opening
72 First Sleeve Second Opening
73 Second Sleeve First Opening
74 Second Sleeve Second Opening
75 Third Sleeve First Opening
76 Third Sleeve Second Opening
77 Fourth Sleeve First Opening
78 Four Sleeve Second Opening

DETAILED DESCRIPTION OF THE PREFERRED EMBODIMENT

The middle panel 11 has a middle panel center 12. The middle panel center defines a center of a circle. The middle panel 11 has a circular shape and is formed of a durable fabric. The middle panel 11 extends outwardly to sidewalls. The sidewalls are of circular shape and contiguous with the middle panel 11. The sidewalls angle upwardly from the middle panel 11. The sidewalls have pleats between them for defining an upward angle from the middle panel 11. The first sidewall 21 is connected to the middle panel 11 and has a second sidewall 22 connected to it at a first pleat 31. The first sidewall 21 is connected to the middle panel 11 at a middle panel fringe 13. The second sidewall 22 is connected to a third sidewall 23 at a second pleat 32. The third sidewall 23 is connected to a fourth sidewall 24 at a third pleat 33. The fourth sidewall 24 is connected to the first sidewall 21 at a fourth pleat 31. The sidewalls have arc shaped profiles and maintain a circular outer edge.

The pleats have a generally triangular shape and taper outwardly from the middle panel fringe 13 to the sleeve stitch 55. The sidewall-based strip 25 connects to the middle panel fringe 13. Each of the pleats are stitched over by a pleat cover panel. The first pleat 31 is stitched over by a first pleat cover panel 41. The second pleat 32 is stitched over by a second pleat cover panel 42. The third pleat 33 is stitched over by a third pleat cover panel 43. The fourth pleat 34 is stitched over by the fourth pleat cover panel 44.

The first pleat 31 extends outwardly and terminates at the first sleeve opening 51. The second pleat 32 extends outwardly and terminates at a second sleeve opening 52. The third pleat 33 extends outwardly and terminates at a third sleeve opening 53. The fourth pleat extends outwardly and terminates at a fourth sleeve opening 54. The first sleeve 56 is connected to the first sidewall 21 at a sleeve stitch 55. The second sleeve 57 is connected to the second sidewall 22 at a sleeve stitch 55. The third sleeve 58 is connected to the third sidewall 23 at a sleeve stitch 55. The fourth sleeve 59 is connected to the fourth sidewall 24 at a sleeve stitch 55. The sleeve openings face outward and provide a hollow tubular sleeve for receiving a metal frame or for receiving rope connections such as a rope connection to a swing suspension.

The base strip 25 is stitched to the middle panel fringe 13. The base strip 25 as a pair of edges, namely an outer edge and an inner edge. The outside edge is folded underneath the base strip 25 and is retained over the first pleat cover panel 41 at a base strip outside stitch 27. The inside edge 26 is folded underneath the base strip 25 and is stitched to the middle panel 11 at the base strip inside stitch 26. The pleat cover panel extends from a lower surface of the pleat to an upper surface of the pleat. The first pleat cover panel 41 has a lower inside edge that is folded underneath the first pleat cover panel 41 to be retained between the middle panel 11 and the first pleat cover panel 41. The folded lower inside edge of the first pleat cover panel 41 is retained to the middle panel 11 at the pleat cover inside stitch 45. The folded edge extends along the length of the pleat at a pleat cover side stitch 47. The pleat cover top stitch 48 retains the top edge of the pleat cover. The top edge of the pleat cover is folded underneath and stitched to the middle panel 11.

The sleeves are added preferably after the pleat covers are attached. The sleeves are connected to the sidewalls along a sleeve outer stitch 61. The sleeve outer stitch 61 connects a folded portion of the sleeve to the sidewalls. The first sleeve 56 for example has a sleeve pocket 63 that extends circumferentially around the periphery of the first sidewall 21. The other sleeves extend similarly around the periphery of the sidewalls. The pleat cover also has an outside stitch 46 that is connected at an outer edge of the pleat cover. The sleeves have a lower connection at the sleeve inner stitch 62. The sleeve inner stitch is at a smaller radius than the pleat cover outside stitch 46. The pleat cover outside stitch 46 is arc-shaped around the center of the middle panel 12 and connects the pleat cover to the middle panel 11.

Each of the sleeves have a pair of sleeve openings. The first sleeve has a first sleeve first opening 71 and a first sleeve second opening 72. The second sleeve has a second sleeve first opening 73 and a second sleeve second opening 74. The third sleeve has a third sleeve first opening 75 and a third sleeve second opening 76. The fourth sleeve has a fourth sleeve first opening 77 and a fourth sleeve second opening 78. The sleeve openings have clearance for allowing a frame such as a metal tubular frame, a wicker frame, or a flexible rope frame to fit through the sleeve openings for suspending the rounded hammock from a hammock frame, a swingset frame or a tree.

The invention claimed is:

1. A rounded hammock comprising:

a middle panel having a rounded profile and a center;

at least four sidewalls, namely a first sidewall, a second sidewall, a third sidewall, and a fourth sidewall connected to the middle panel;

a first pleat formed on the first sidewall, a second pleat formed on the second sidewall, a third pleat formed on the third sidewall, and a fourth pleat formed on the fourth sidewall;

a first pleat cover stitched over the first pleat, a second pleat cover stitched over the second pleat, a third pleat cover stitched over the third pleat, and a fourth pleat cover stitched over the fourth pleat; and at least four sleeves stitched to the four sidewalls, wherein each of the at least four sleeves has a sleeve pocket with a pair of openings, wherein the at least four sleeves includes a first sleeve stitched to the first sidewall, a second sleeve stitched the second sidewall, a third sleeve stitched to the third sidewall, and a fourth sleeve stitched to the fourth sidewall, wherein the first sleeve is stitched at least partially over the first pleat cover, wherein the second sleeve is stitched at least partially over the second pleat cover, wherein the third sleeve is stitched at least partially over the third pleat cover, wherein the fourth sleeve is stitched at least partially over the fourth pleat cover.

2. The rounded hammock of claim 1, further including: a sidewall base strip stitched between the at least four sidewalls and the middle panel at a middle panel fringe.

3. The rounded hammock of claim 2, wherein the sidewall base strip further includes a base strip inside stitch and a base strip outside stitch, wherein the base strip inside stitch is connected to the middle panel, and wherein the base strip outside stitch is connected to the at least four sidewalls.

4. The rounded hammock of claim 2, wherein the at least four sleeves are connected to the at least four sidewalls by a sleeve inner stitch and a sleeve outer stitch, wherein the sleeve inner stitch has a smaller diameter than the sleeve outer stitch.

5. The rounded hammock of claim 4, further including: a sidewall base strip stitched between the at least four sidewalls and the middle panel at a middle panel fringe.

6. The rounded hammock of claim 5, wherein the sidewall base strip further includes a base strip inside stitch and a base strip outside stitch, wherein the base strip inside stitch is connected to the middle panel, and wherein the base strip outside stitch is connected to the at least four sidewalls.

7. The rounded hammock of claim 6, wherein each of the pleat covers including the first pleat cover, the second pleat cover, the third pleat cover and the fourth pleat cover a pleat cover panel extends from a lower surface of each respective pleat to an upper surface of each respective pleat, wherein each pleat cover panel has a lower inside edge that is folded underneath each respective pleat cover panel to be retained between the middle panel and each respective pleat cover panel.

* * * * *